US011742635B2

(12) United States Patent
Sugiura

(10) Patent No.: US 11,742,635 B2
(45) Date of Patent: Aug. 29, 2023

(54) SPARK PLUG FOR INTERNAL COMBUSTION ENGINE AND METHOD OF MANUFACTURING THE SAME

(71) Applicant: DENSO CORPORATION, Kariya (JP)

(72) Inventor: Akimitsu Sugiura, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 18/157,738

(22) Filed: Jan. 20, 2023

(65) Prior Publication Data

US 2023/0163574 A1 May 25, 2023

Related U.S. Application Data

(63) Continuation of application No. PCT/JP2021/023293, filed on Jun. 21, 2021.

(30) Foreign Application Priority Data

Jul. 22, 2020 (JP) ..... 2020-125644

(51) Int. Cl.
*H01T 13/54* (2006.01)
*H01T 13/34* (2006.01)
(Continued)

(52) U.S. Cl.
CPC ..... *H01T 13/34* (2013.01); *H01T 13/06* (2013.01); *H01T 13/54* (2013.01); *H01T 21/02* (2013.01)

(58) Field of Classification Search
CPC ..... H01T 13/06; H01T 13/54
(Continued)

(56) References Cited

U.S. PATENT DOCUMENTS 10,174,667 B1 1/2019 Cress
2009/0309475 A1* 12/2009 Tozzi ..... H01T 13/54 313/143
(Continued)

FOREIGN PATENT DOCUMENTS

DE 10 2017 202 238 2/2018
DE 10 2018 211 009 1/2020
(Continued)

OTHER PUBLICATIONS

International Search Report dated Sep. 7, 2021, for PCT/JP2021/023293, 2 pp.
(Continued)

*Primary Examiner* — Christopher M Raabe
(74) *Attorney, Agent, or Firm* — Nixon & Vanderhye P.C.

(57) ABSTRACT

A spark plug for an internal combustion engine includes a cylindrical insulator, a center electrode, a cylindrical housing, and a plug cover. On a tip side of the insulator, an auxiliary combustion chamber is formed which is surrounded by at least the plug cover. The plug cover is provided with nozzle holes that communicate between the auxiliary combustion chamber and the outside of the auxiliary combustion chamber. A central axis of the nozzle hole is inclined with respect to a plug radial direction when viewed in a plug axial direction. At least a part around an outer opening of the nozzle hole is provided with a concave portion that is adjacent to the outer opening. The concave portion is recessed from the outside to the inside of the plug cover.

3 Claims, 9 Drawing Sheets

(51) Int. Cl.
*H01T 13/06* (2006.01)
*H01T 21/02* (2006.01)

(58) Field of Classification Search
USPC ..... 313/118
See application file for complete search history.

(56) References Cited

U.S. PATENT DOCUMENTS

| | | | | |
|---|---|---|---|---|
| 2011/0005077 | A1 | 1/2011 | Higuma et al. | |
| 2012/0125279 | A1* | 5/2012 | Hampson | F02P 15/10 445/7 |
| 2016/0053670 | A1* | 2/2016 | Tozzi | F02P 13/00 123/260 |
| 2020/0185889 | A1* | 6/2020 | Niessner | H01T 13/20 |

FOREIGN PATENT DOCUMENTS

| | | |
|---|---|---|
| JP | 2009-252665 | 10/2009 |
| JP | 2009-270539 | 11/2009 |
| JP | 2010-174765 | 8/2010 |
| JP | 2014-129788 | 7/2014 |

OTHER PUBLICATIONS

Written Opinion of the International Searching Authority dated Sep. 7, 2021, for PCT/JP2021/023293, 3 pp.

* cited by examiner

SPARK PLUG FOR INTERNAL COMBUSTION ENGINE AND METHOD OF MANUFACTURING THE SAME

CROSS-REFERENCE TO RELATED APPLICATION

This application is a continuation application of International Application No. PCT/JP2021/023293 filed on Jun. 21, 2021 which designated the U.S. and claims priority to Japanese Patent Application No. 2020-125644 filed Jul. 22, 2020, the contents of both of which are incorporated herein by reference.

BACKGROUND

Technical Field

The present disclosure relates to a spark plug for an internal combustion engine and a method of manufacturing the same.

Related Art

For example, a spark plug is known which is configured to form a swirl flow, which is an airflow in the circumferential direction, in an auxiliary combustion chamber provided to a tip of the spark plug.

SUMMARY

As an aspect of the present disclosure, a spark plug for an internal combustion engine is provided. The spark plug includes: a cylindrical insulator; a center electrode that is held on an inner periphery side of the insulator and projects from the insulator toward a tip side of the insulator; a cylindrical housing that holds the insulator on an inner periphery of the housing; and a plug cover that is provided to a tip portion of the housing. On the tip side of the insulator, an auxiliary combustion chamber is formed which is surrounded by at least the plug cover, the plug cover is provided with nozzle holes that communicate between the auxiliary combustion chamber and the outside of the auxiliary combustion chamber. A central axis of the nozzle hole is inclined with respect to a plug radial direction when viewed in a plug axial direction. At least a part around an outer opening of the nozzle hole is provided with a concave portion that is adjacent to the outer opening, the concave portion being recessed from the outside to the inside of the plug cover.

DETAILED DESCRIPTION OF THE PREFERRED EMBODIMENTS

For example, as disclosed in DE102018211009, a spark plug is known which is configured to form a swirl flow, which is an airflow in the circumferential direction, in an auxiliary combustion chamber provided to a tip of the spark plug. A plug cover forming the auxiliary combustion chamber is provided with a plurality of nozzle holes, which have a central axis inclined with respect to the radial direction of the spark plug when viewed in the direction parallel to a central axis of the spark plug. Gas is caused to flow from a main combustion chamber of an internal combustion engine to the auxiliary combustion chamber through the nozzle holes to form a swirl flow in the auxiliary combustion chamber.

In the spark plug described in DE102018211009, the nozzle holes are formed in a portion having a convex curved surface, which is an outer surface of the plug cover projecting outward. Hence, the nozzle holes are difficult to form in the plug cover by cutting work with a drill, press work with a punch, or the like. Thus, when the nozzle holes are formed, laser beam machining, electrical discharge machining, or the like may be required. In this case, productivity lowers easily due to increase in machining effort.

The present disclosure provides a spark plug and a method of manufacturing the same that can increase productivity.

First Embodiment

An embodiment of a spark plug for an internal combustion engine and a method of manufacturing the same will be described with reference to FIG. 1 to FIG. 9.

Figure 1:
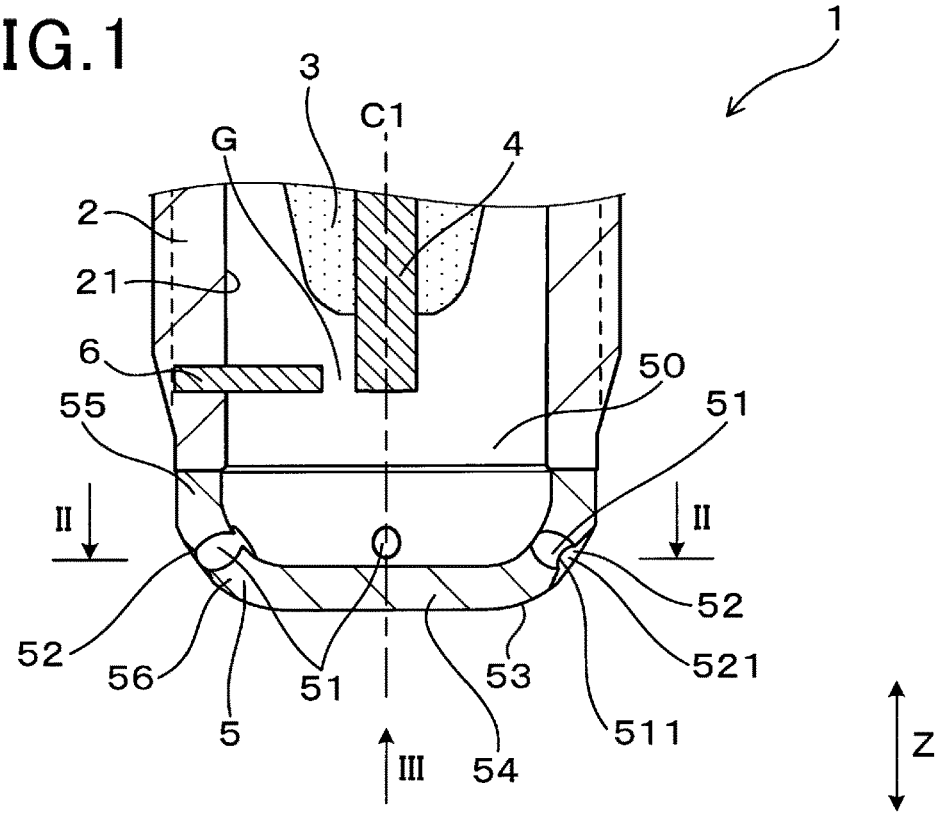
FIG. 1 is a cross-sectional view of a tip portion of a spark plug and is a cross-sectional view taken across a line I-I of FIG. 3, according to a first embodiment.

As illustrated in FIG. 1, a spark plug 1 for an internal combustion engine of the present embodiment has a cylindrical insulator 3, a center electrode 4, a cylindrical housing 2, and a plug cover 5. The center electrode 4 is held on the inner periphery side of the insulator 3 and projects from the insulator 3 toward the tip side thereof. The housing 2 holds the insulator 3 on the inner periphery side thereof. The plug cover 5 is provided to a tip portion of the housing 2. On the tip side of the insulator 3, an auxiliary combustion chamber 50 is formed which is surrounded by at least the plug cover 5.

Figure 2:
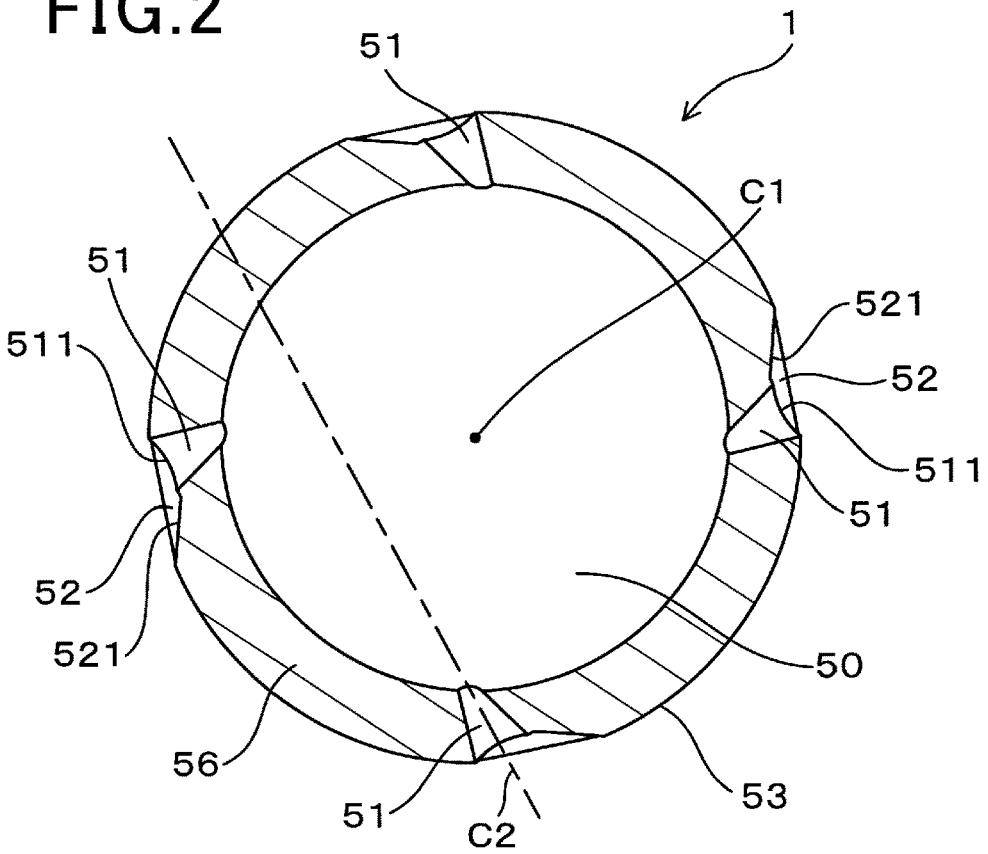
FIG. 2 is a cross-sectional view taken across a line II-II of FIG. 1.
Figure 3:
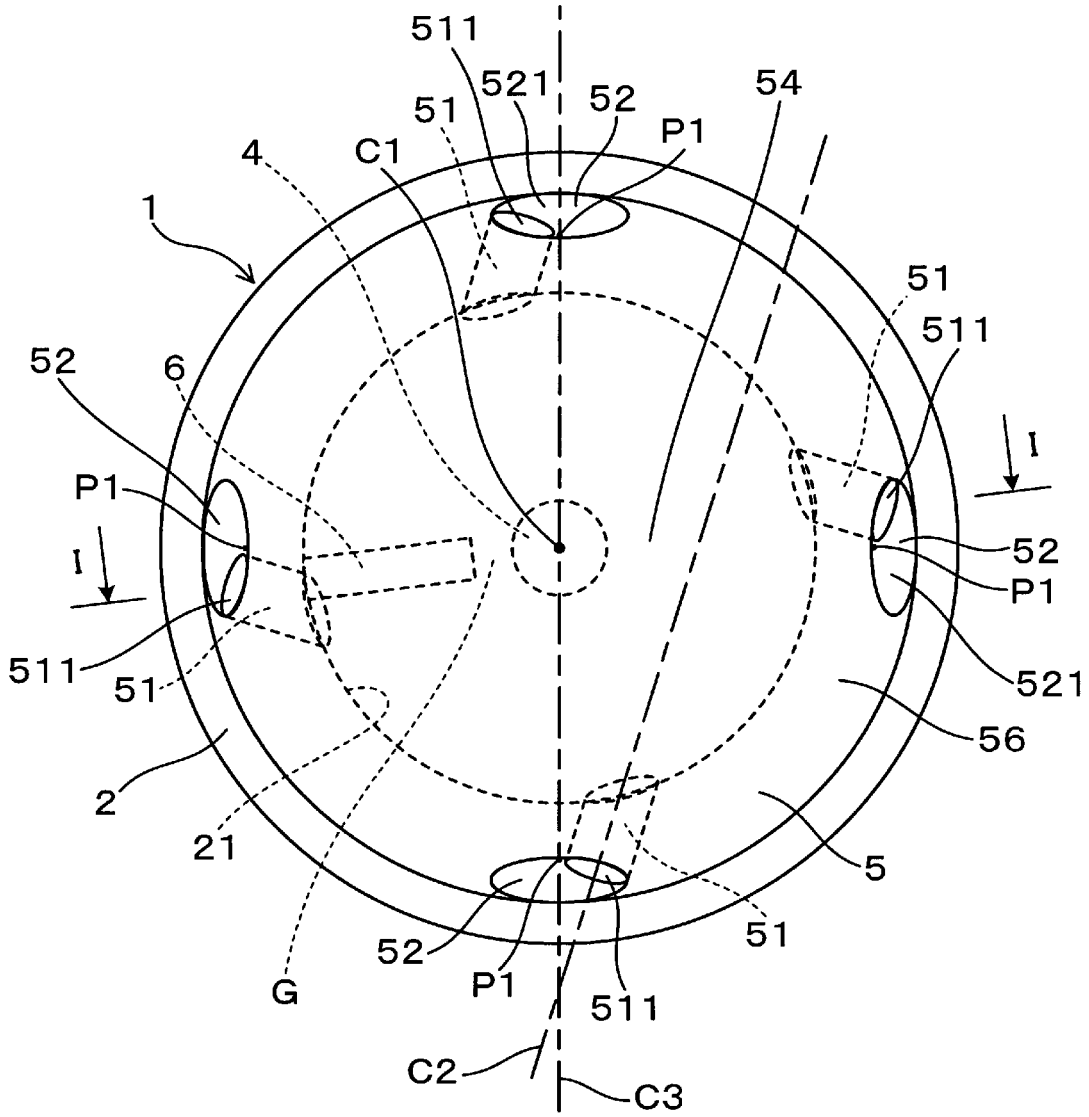
FIG. 3 is a plan view viewed in the direction of an arrow III of FIG. 1.

The plug cover 5 is provided with nozzle holes 51 that communicate between the auxiliary combustion chamber 50 and the outside of the auxiliary combustion chamber 50. As illustrated in FIG. 2 and FIG. 3, a central axis C2 of the nozzle hole 51 is inclined with respect to a plug radial direction when viewed in a plug axial direction Z. As illustrated in FIG. 1 to FIG. 3, at least a part around an outer opening 511 of the nozzle hole 51 is provided with a concave portion 52 that is adjacent to the outer opening 511. The concave portion 52 is recessed from the outside to the inside of the plug cover 5.

The spark plug 1 of the present embodiment can be used as, for example, an ignition means of an internal combustion engine for a vehicle such as an automobile. Herein, a plug central axis C1 means the central axis C1 of the spark plug 1. The direction parallel to the plug central axis C1 is appropriately referred to as a plug axial direction or a Z direction. The side in the Z direction that is connected to an ignition coil (not shown) is referred to as a base end side, and the side that is located in a main combustion chamber (not shown) is referred to as a tip side. The plug radial direction means a radial direction of a circle centering on the plug central axis C1 on a plane orthogonal to the plug central axis C1.

As illustrated in FIG. 1 and FIG. 3, the center electrode 4 has a substantially columnar shape as a whole. The insulator 3 holding the center electrode 4 is held by the housing 2 having a substantially cylindrical shape.

An earth electrode 6 is joined to the housing 2 so that a discharge gap G is formed between the earth electrode 6 and the center electrode 4. The earth electrode 6 is fixed to the housing 2 so that the longitudinal direction thereof is along the plug radial direction. The earth electrode 6 projects from an inner periphery 21 of the housing 2 toward the center electrode 4. The earth electrode 6 and an outer periphery of the center electrode 4 face each other in the plug radial direction. The discharge gap G is formed between the earth electrode 6 and the outer periphery of the center electrode 4.

The tip portion of the housing 2 is provided with the plug cover 5. In the present embodiment, as illustrated in FIG. 1, the plug cover 5 has a bottom wall portion 54, a peripheral wall portion 55, and a corner portion 56. The bottom wall portion 54 covers the tip side of the auxiliary combustion chamber 50. The peripheral wall portion 55 has a substantially cylindrical shape covering the outer periphery of the auxiliary combustion chamber 50. The corner portion 56 connects the outer periphery of the bottom wall portion 54 and the tip of the peripheral wall portion 55 in a curved surface shape. In the present embodiment, the plug cover 5 is formed from, for example, iron, nickel, an alloy of iron or nickel, stainless steel, or the like.

In the present embodiment, as illustrated in FIG. 1, the nozzle holes 51 are formed in the corner portion 56 of the plug cover 5. The nozzle holes 51 are formed in a portion having a convex curved surface, which is an outer surface 53 of the plug cover 5 projecting outward. When the spark plug 1 is installed in an internal combustion engine (not shown), the outer surface 53 of the plug cover 5 faces the main combustion chamber. That is, when the spark plug 1 is installed in the internal combustion engine, the outer opening 511 of the nozzle hole 51 faces the main combustion chamber.

In the corner portion 56 of the plug cover 5, a plurality of nozzle holes 51 are formed. In the present embodiment, as illustrated in FIG. 2 and FIG. 3, four nozzle holes 51 are formed in the corner portion 56. As illustrated in FIG. 3, the plurality of nozzle holes 51 are arranged in a plug circumferential direction at regular intervals when viewed in the Z direction. The two nozzle holes 51 facing each other in the plug circumferential direction are formed so as to be approximately point symmetrical about the plug central axis C1 when viewed in the Z direction. The number of the nozzle holes 51 may be three or less. The number of the nozzle holes 51 may be five or more. The plug circumferential direction means a circumferential direction about the plug central axis C1 on the plane orthogonal to the plug central axis C1.

Figure 4:
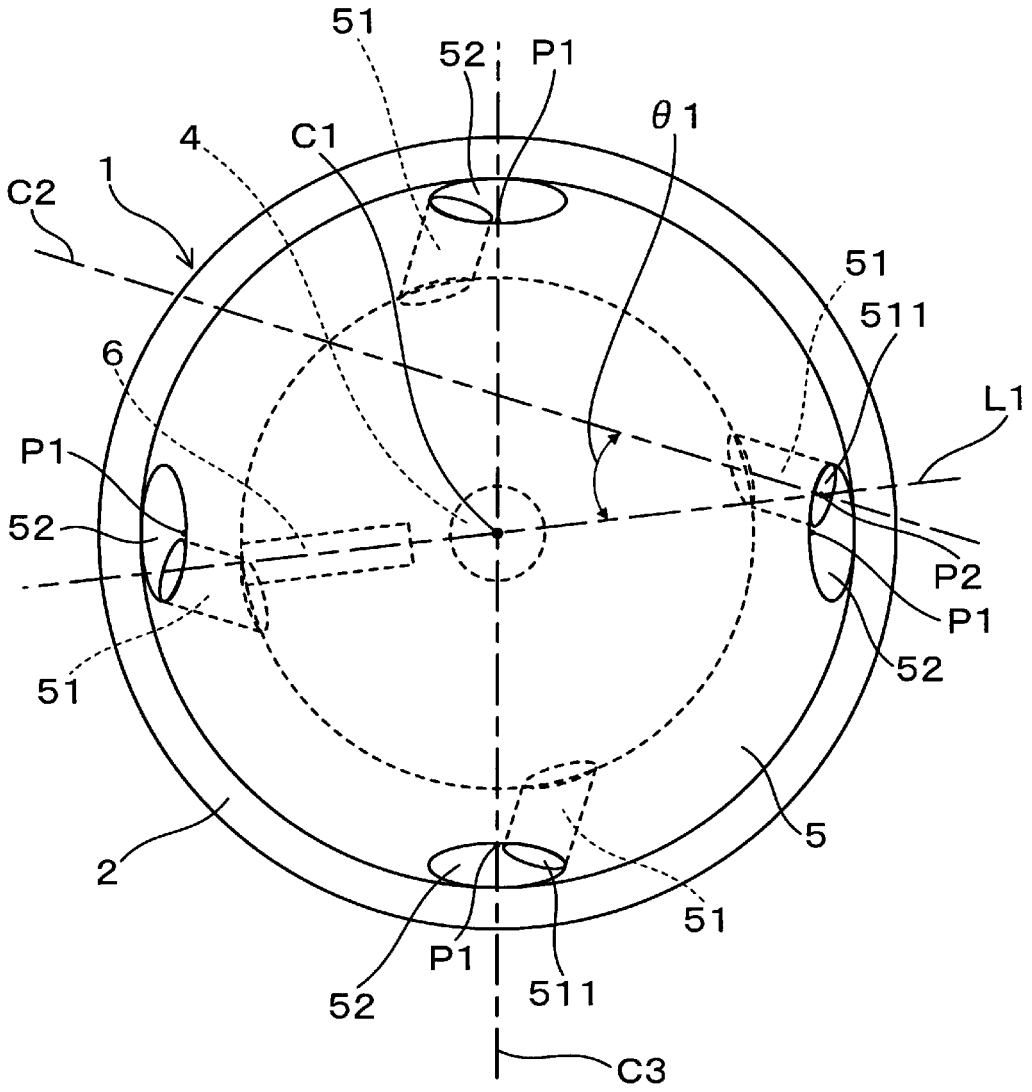
FIG. 4 is a plan view of the spark plug viewed from a tip side thereof for describing directions in which nozzle holes open, according to the first embodiment.

As illustrated in FIG. 4, the point at which the outer opening 511 of the nozzle hole 51 and the central axis C2 of the nozzle hole 51 intersect with each other is defined as a point P2. When viewed in the Z direction, a straight line passing through the point P2 and the plug central axis C1 is defined as a straight line L1. That is, the straight line L1 extends in the plug radial direction. In the present embodiment, when viewed in the Z direction, each of the nozzle holes 51 is formed so that an angle θ1, which is a smaller angle between the straight line L1 and the central axis C2 of the nozzle hole 51, is, for example, 20° or more. When viewed in the Z direction, in the nozzle holes 51, the central axis C2 is displaced from the straight line L1 in the same rotational direction by the approximately same angle about the point P2. That is, the nozzle holes 51 are formed so that the angles θ1 are approximately the same when viewed in the Z direction.

As described above, when viewed in the Z direction, the central axis C2 of the nozzle hole 51 is inclined with respect to the plug radial direction. In other words, when viewed in the Z direction, the direction in which the nozzle hole 51 opens is inclined with respect to the plug radial direction.

As described in FIG. 1, each of the nozzle holes 51 opens with inclination with respect to the Z direction so that the nozzle hole 51 extends outward with respect to the plug radial direction as the nozzle hole 51 extends toward the tip side.

The nozzle hole 51 is formed so that when gas externally flows into the auxiliary combustion chamber 50 through the nozzle holes 51, a swirl flow is generated in the auxiliary combustion chamber 50. Herein, the swirl flow means an airflow swirling about the plug central axis C1.

That is, when the spark plug 1 is mounted to the internal combustion engine, in a compression stroke, gas flows from the main combustion chamber into the auxiliary combustion chamber 50 through the nozzle holes 51. In this case, when the spark plug 1 is viewed from the tip side thereof, a swirl flow in a counterclockwise direction is formed in the auxiliary combustion chamber 50. In an expansion stroke, since the main combustion chamber becomes negative pressure with respect to the auxiliary combustion chamber 50, gas flows from the auxiliary combustion chamber 50 to the main combustion chamber through the nozzle holes 51. In this case, when the spark plug 1 is viewed from the tip side thereof, a swirl flow in a clockwise direction is formed in the auxiliary combustion chamber 50.

As illustrated in FIG. 1 to FIG. 3, in the corner portion 56 of the plug cover 5, the concave portions 52 are formed. As illustrated in FIG. 2 and FIG. 3, four concave portions 52 are formed in the corner portion 56. As illustrated in FIG. 3, the concave portions 52 are arranged in the plug circumferential direction at regular intervals. In each of the concave portions 52, the nozzle hole 51 opens on a concave portion forming face 521 on which the concave portion 52 is formed.

Figure 5:
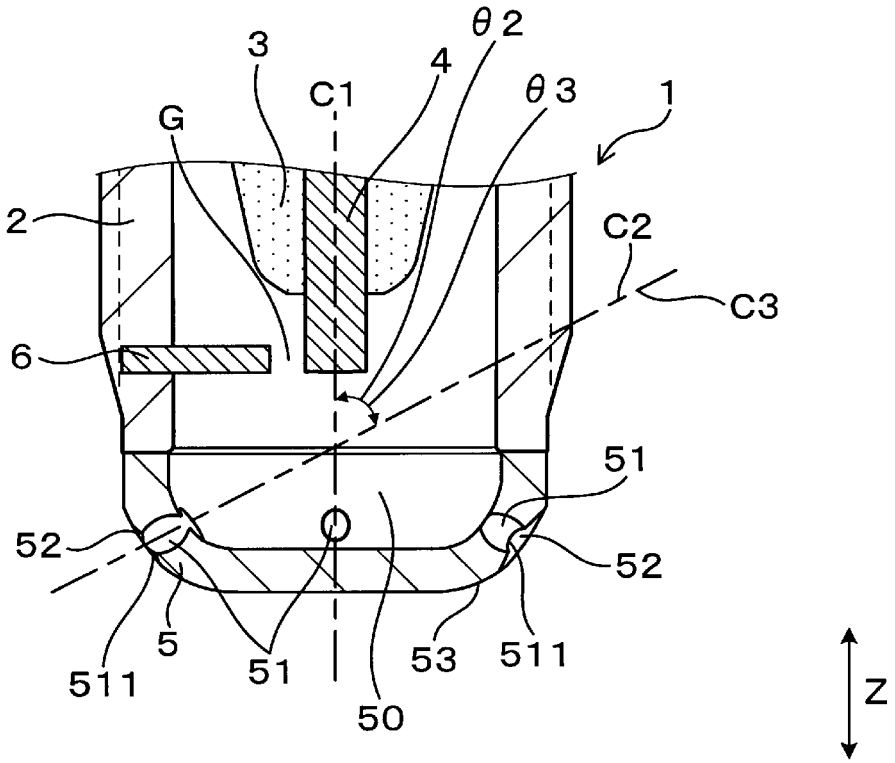
FIG. 5 is a cross-sectional view of the tip portion of the spark plug for describing an angle between a central axis of the nozzle hole and a central axis of the plug, according to the first embodiment.

In the present embodiment, the concave portion 52 has a substantially conical shape. As illustrated in FIG. 5, a central axis C3 of the concave portion 52 is inclined with respect to the Z direction. As illustrated in FIG. 3 and FIG. 5, the central axis C3 of the concave portion 52 passes through the plug central axis C1. The concave portion 52 may have, instead of the substantially conical shape, a substantially quadrangular pyramid shape as described in the second embodiment later. When viewed in a direction parallel to the central axis C3 of the concave portion 52, the concave portion 52 may be formed so as to have a polygonal shape such as a substantially semicircular shape, a triangular shape, or the like.

Figure 6:
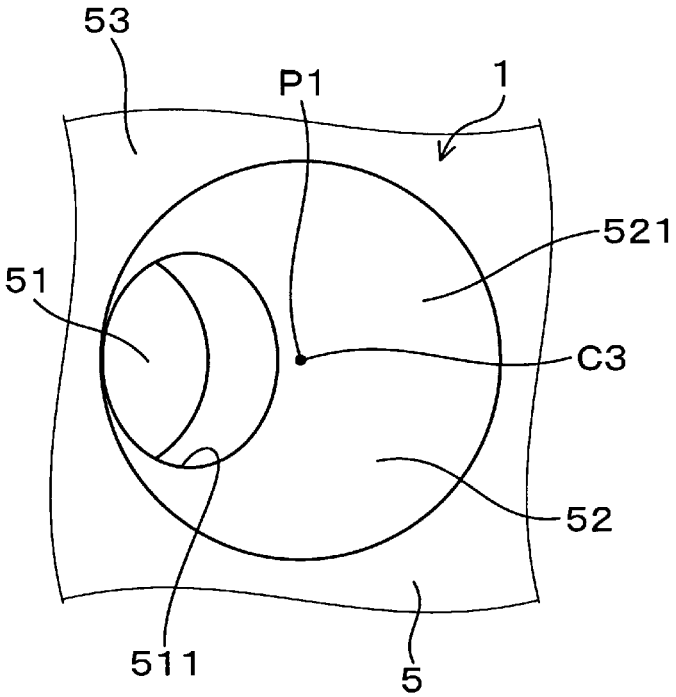
FIG. 6 is an enlarged plan view of the periphery of a concave portion viewed in a direction parallel to a central axis of the concave portion, according to the first embodiment.

As illustrated in FIG. 1 to FIG. 3, the outer opening 511 of the nozzle hole 51 is formed in the concave portion forming face 521 on which the concave portion 52 is formed. As illustrated in FIG. 6, viewed in a direction parallel to the central axis C3 of the concave portion 52, the center of the outer opening 511 is displaced from the center P1 of the concave portion 52. The outer opening 511 is formed at a position separated from the center P1 of the concave portion 52. The concave portion forming face 521 is formed so as to surround the outer opening 511.

As illustrated in FIG. 3, the outer opening 511 opens at a position deviated from the center P1 of the concave portion 52 in one of the plug circumferential directions.

In the present embodiment, the central axis C2 of the nozzle hole 51 and the central axis C3 of the concave portion 52, in which the nozzle hole 51 is formed, are formed on the substantially same plane. Hence, as illustrated in FIG. 5, when the spark plug 1 is viewed in a predetermined plug radial direction, the central axis C2 and the central axis C3 can be aligned. In this case, a smaller angle θ2 between the central axis C2 and the plug central axis C1 is approximately the same as a smaller angle θ3 between the central axis C3 and the plug central axis C1. That is, the smaller angle between the plane, which includes the central axis C2 and the central axis C3, and the plug central axis C1 is θ2 or θ3. The angles θ2 and θ3 are, for example, 45° to 75°.

Figure 7:
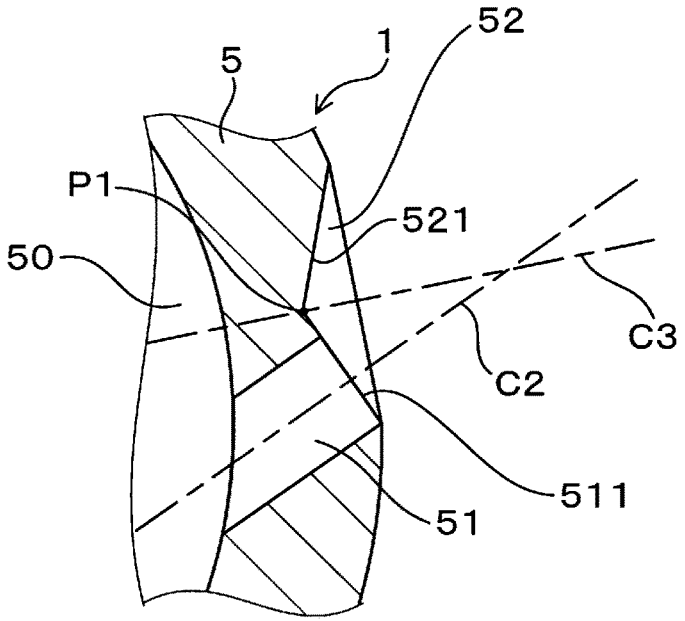
FIG. 7 is an enlarged cross-sectional view of the periphery of the nozzle hole for describing a direction in which the nozzle hole opens, according to the first embodiment.

As illustrated in FIG. 7, on a cross section including the central axis C2 and the central axis C3, the nozzle hole 51 opens so that the contour of the outer opening 511 of the nozzle hole 51 formed in the concave portion forming face 521 is approximately orthogonal to central axis C2 of the nozzle hole 51.

Next, a method of manufacturing the spark plug 1 of the present embodiment will be described.

In the method of manufacturing a spark plug for an internal combustion engine, when the nozzle holes 51 are formed in the plug cover 5, the concave portions 52 are formed in the plug cover 5. After the concave portion 52 is formed, the nozzle hole 51 is produced in at least a part of the concave portion forming face 521 on which the concave portion 52 is formed.

In the present embodiment, the nozzle hole 51 is produced in part of the concave portion forming face 521. The nozzle hole 51 may be produced in the whole concave portion forming face 521.

Figure 8:
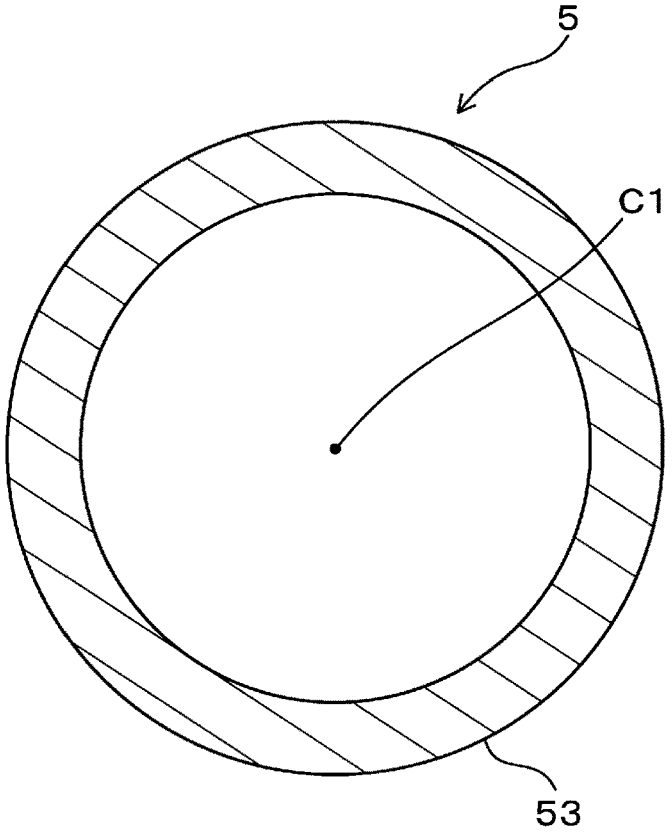
FIG. 8 is a cross-sectional view of a plug cover before the concave portions are formed, according to the first embodiment.
Figure 9:
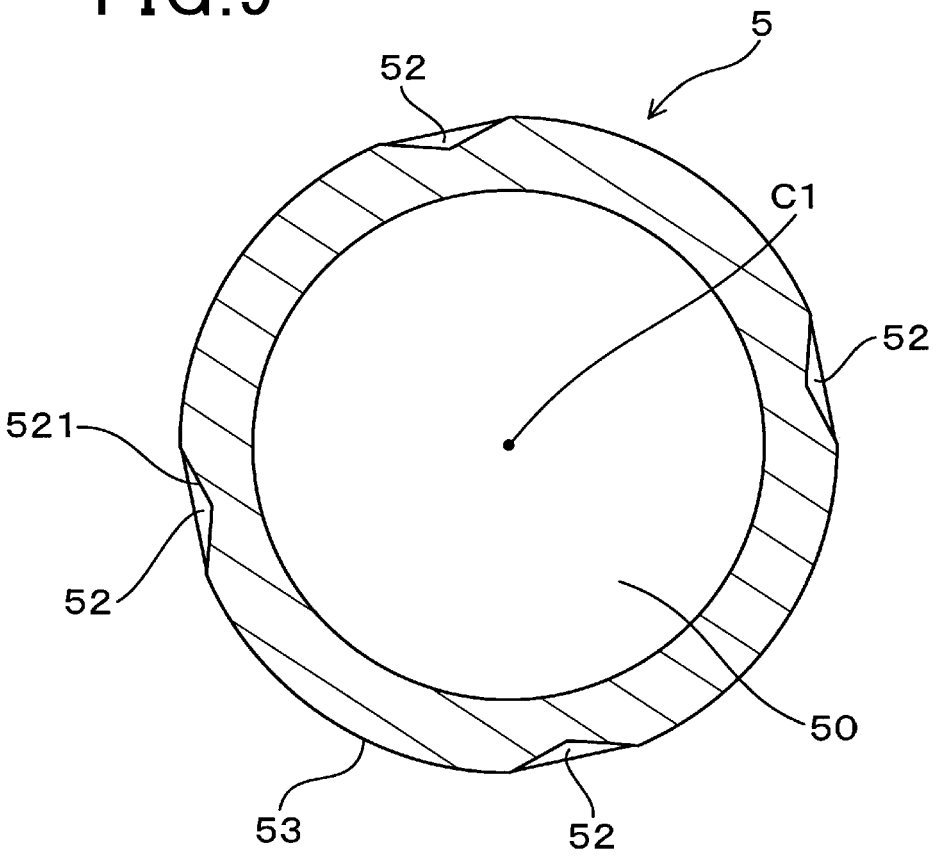
FIG. 9 is a cross-sectional view of the plug cover after the concave portions are formed, according to the first embodiment.

In the present embodiment, the concave portion 52 is formed by using a drill. Performing cutting work with a drill for the unprocessed plug cover 5 as illustrated in FIG. 8 forms the concave portions 52 in the plug cover 5 as illustrated in FIG. 9. Specifically, cutting work with a drill is performed along a normal direction of the outer surface 53 of the plug cover 5. Hence, the concave portions 52 having a substantially conical shape are formed. As described in second and third embodiments later, the concave portions 52 can also be formed by press work with a punch.

Next, the nozzle hole 51 is produced in the concave portion forming face 521, on which the concave portion 52 is formed, from the outside toward the auxiliary combustion chamber 50. In the present embodiment, the nozzle hole 51 is formed by cutting work with a drill. Part of the concave portion forming face 521 of the plug cover 5 is subjected to cutting work with a drill along the normal direction of the part of the concave portion forming face 521. Hence, as illustrated in FIG. 1 to FIG. 3 and FIG. 6, the nozzle hole 51 can be formed so that the concave portion 52 is adjacent to the outer opening 511.

Next, effects of the present embodiment will be described.

In the spark plug 1 for an internal combustion engine of the present embodiment, the concave portion 52 is formed in at least a part around the outer opening 511 of the nozzle hole 51 so as to be adjacent to the outer opening 511. Hence, when viewed in the plug axial direction Z, even if the central axis C2 of the nozzle hole 51 is inclined with respect to the plug radial direction, the plug cover 5 can be processed easily. As a result, productivity in manufacturing the spark plug 1 can be increased.

In the method of manufacturing the spark plug 1 for an internal combustion engine according to the present embodiment, after the concave portion 52 is formed in the plug cover 5, the nozzle hole 51 is produced in at least a part of the concave portion forming face 521. Hence, when viewed in the plug axial direction Z, even if the central axis C2 of the nozzle hole 51 is inclined with respect to the plug radial direction, the plug cover 5 can be processed easily. As a result, the spark plug 1 can be manufactured effectively.

That is, if processing of the plug cover 5 is attempted without forming the concave portion 52, the nozzle hole 51 is difficult to form in a portion having a convex curved surface, which is the outer surface 53 of the plug cover 5 projecting outward, by cutting work or the like. That is, even if producing the nozzle hole 51 is attempted in the direction inclined with respect to the normal direction of the outer surface 53, since a tip of a drill or a punch slips, the nozzle hole 51 is difficult to form. In contrast, the spark plug 1 of the present embodiment can be manufactured by producing the nozzle hole 51 in the concave portion forming face 521 after the concave portion 52 is formed in the plug cover 5. That is, providing the concave portion 52 can form a surface approximately orthogonal to central axis C2 of the nozzle hole 51 to be formed in part of the outer surface 53 of the plug cover 5. In addition, the nozzle hole 51 can be produced in the surface, that is, on the part of the concave portion forming face 521 along the normal direction thereof. Hence, the nozzle hole 51 can be formed easily even if the central axis C2 of the nozzle hole 51 is inclined with respect to the plug radial direction when viewed in the Z direction. As a result, productivity in manufacturing the spark plug 1 can be increased.

In addition, changing the shape of the drill or the like used for forming the concave portion 52 can form the concave portion 52 in advance depending on the inclination of the nozzle hole 51 to be formed. That is, a desired direction in which the nozzle hole 51 opens and the normal direction of part of the concave portion forming face 521 can be closed to each other. Hence, the nozzle hole 51 having a desired inclination can be easily produced in the plug cover 5.

The outer opening 511 opens at a position deviated from the center P1 of the concave portion 52 in one of the plug circumferential directions. Hence, when viewed in the Z direction, even if the central axis C2 of the nozzle hole 51 is inclined with respect to the plug radial direction, the plug cover 5 can be formed easily. As a result, the spark plug 1 can be manufactured effectively.

That is, the concave portion 52 can be easily formed by cutting work with a drill along the normal direction of the outer surface 53 of the plug cover 5. Then, the nozzle hole 51 is produced in the concave portion forming face 521 at the position, which is deviated from the center P1 in one of the plug circumferential directions, along the normal direction of the part of the concave portion forming face 521. Hence, the nozzle hole 51 having the central axis C2 inclined with respect to the plug radial direction when viewed in the Z direction can be easily formed. As a result, the spark plug 1 can be manufactured effectively.

In the present embodiment, the nozzle holes 51 and the concave portions 52 are formed so that the angle θ2 and the angle θ3 are the same. Hence, before the nozzle hole 51 is formed, the concave portion forming face 521 having a normal line along the central axis C2 of the nozzle hole 51 to be formed can be formed easily. As a result, the nozzle hole 51 can be reliably formed at a desired position.

In the present embodiment, the concave portion 52 has a substantially conical shape. Hence, the nozzle hole 51 can be formed easily by cutting work with a drill. Thus, using a multiaxial drill processing machine can easily perform forming the concave portion 52 and forming the nozzle hole 51 consistently. As a result, the nozzle hole 51 can be produced effectively.

As described above, according to the present embodiment, the spark plug 1 and a method of manufacturing the same that can increase productivity can be provided.

Second Embodiment

Figure 10:
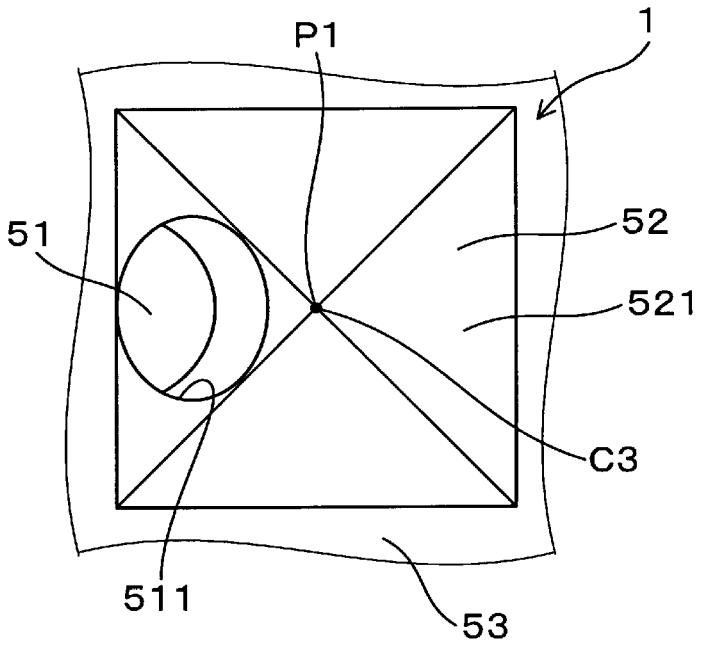
FIG. 10 is an enlarged plan view of the periphery of the concave portion viewed in a direction parallel to the central axis of the concave portion, according to a second embodiment.

In the present embodiment, as illustrated in FIG. 10, the shape of the concave portion 52 of the first embodiment is modified.

In the present embodiment, as illustrated in FIG. 10, the concave portion 52 has a substantially quadrangular pyramid shape. The concave portion 52 includes four flat concave portion forming faces 521. Each of the four concave portion forming face 521 has a substantially triangular shape.

In the present embodiment, the concave portion 52 is formed by using a punch whose tip portion has a substantially quadrangular pyramid shape, and subjecting press work to the plug cover 5. That is, the punch is pressed along the normal of the plug cover 5. Hence, part of the plug cover 5 pressed by the punch is plastically deformed, whereby the concave portion 52 is formed.

After the concave portion 52 is produced, the nozzle hole 51 is produced by a drill along the normal direction of one concave portion forming face 521. That is, the nozzle hole 51 is produced by a drill in one concave portion forming face 521 having a substantially triangular shape along the direction orthogonal to the concave portion forming face 521. The nozzle hole 51 may be formed by punching out part of the plug cover 5 by press work with a punch.

Other configurations are similar to those of the first embodiment. In the second and later embodiments, the same reference signs as those used in the aforementioned embodiments indicate elements similar to those in the aforementioned embodiments unless otherwise indicated.

In the present embodiment, the concave portion 52 is formed of the flat concave portion forming face 521. Hence, the nozzle hole 51 can be easily produced in the concave portion forming face 521 along the normal direction of the concave portion forming face 521. As a result, the nozzle hole 51 can be produced further effectively.

The present embodiment provides other effects similar to those of the first embodiment.

Third Embodiment

Figure 11:
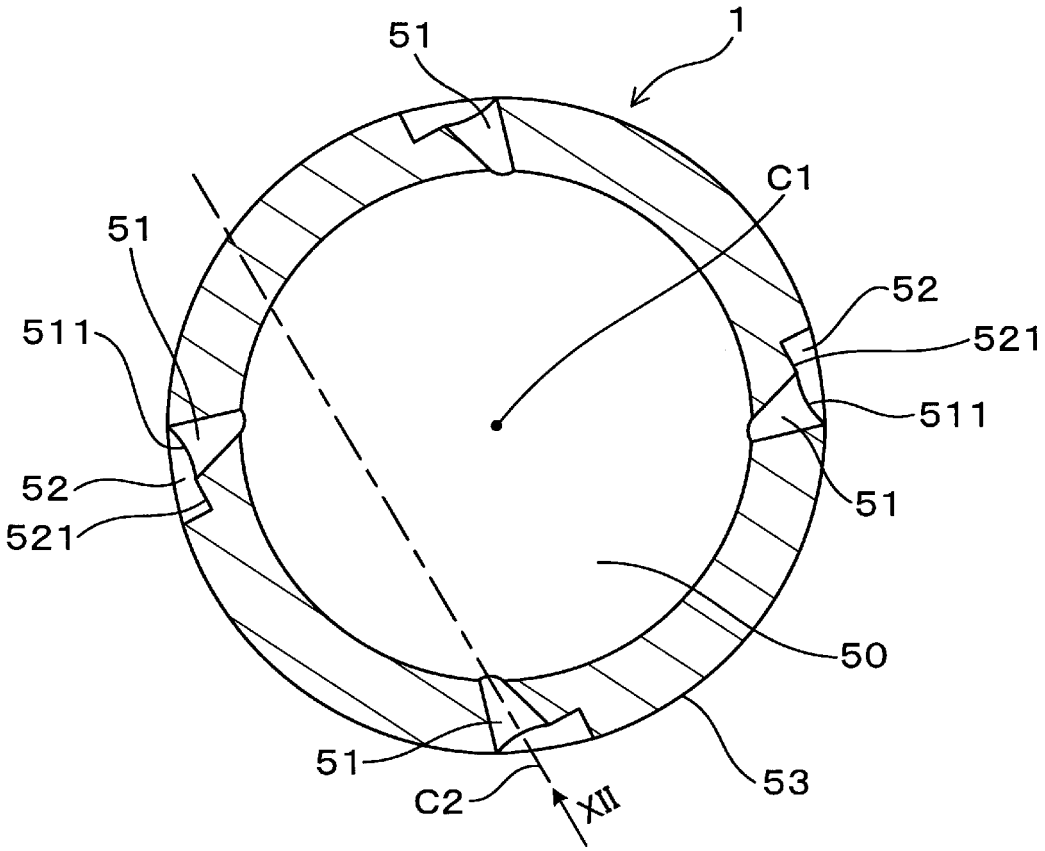
FIG. 11 is a cross-sectional view of the tip portion of the spark plug orthogonal to the central axis of the plug, according to a third embodiment.
Figure 12:
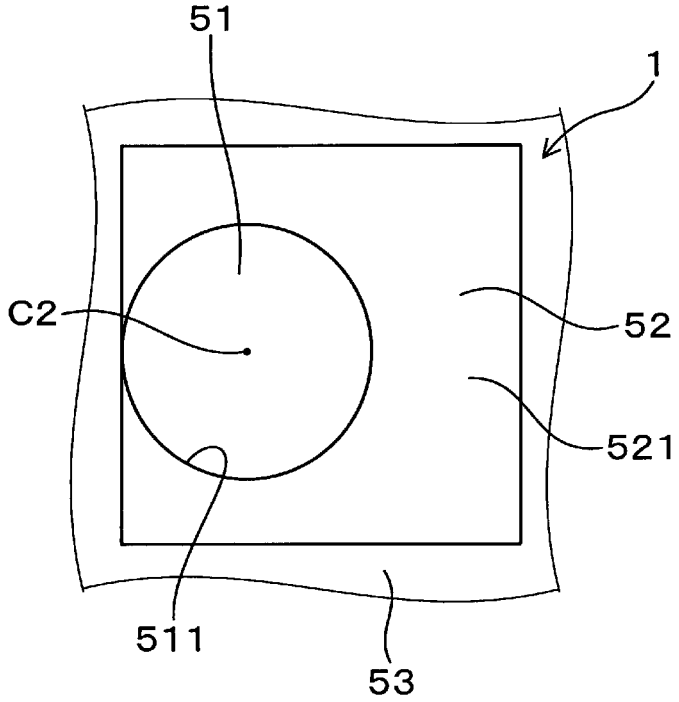
FIG. 12 is a plan view viewed in the direction of an arrow XII of FIG. 11.

In the present embodiment, as illustrated in FIG. 11 and FIG. 12, the shape of the concave portion 52 of the second embodiment is modified.

In the present embodiment, as illustrated in FIG. 12, when viewed in the direction parallel to the central axis C2 of the nozzle hole 51, the concave portion 52 has a substantially square shape. As illustrated in FIG. 11 and FIG. 12, the concave portion 52 has the flat concave portion forming face 521.

In the present embodiment, the concave portion 52 is formed by using a punch whose tip portion has a substantially quadrangular pyramid shape, and subjecting press work to the plug cover 5. After the concave portion 52 is formed, the nozzle hole 51 is produced by a drill in the direction orthogonal to the flat concave portion forming face 521.

The present embodiment provides other configurations and effects similar to those of the second embodiment.

Fourth Embodiment

Figure 13:
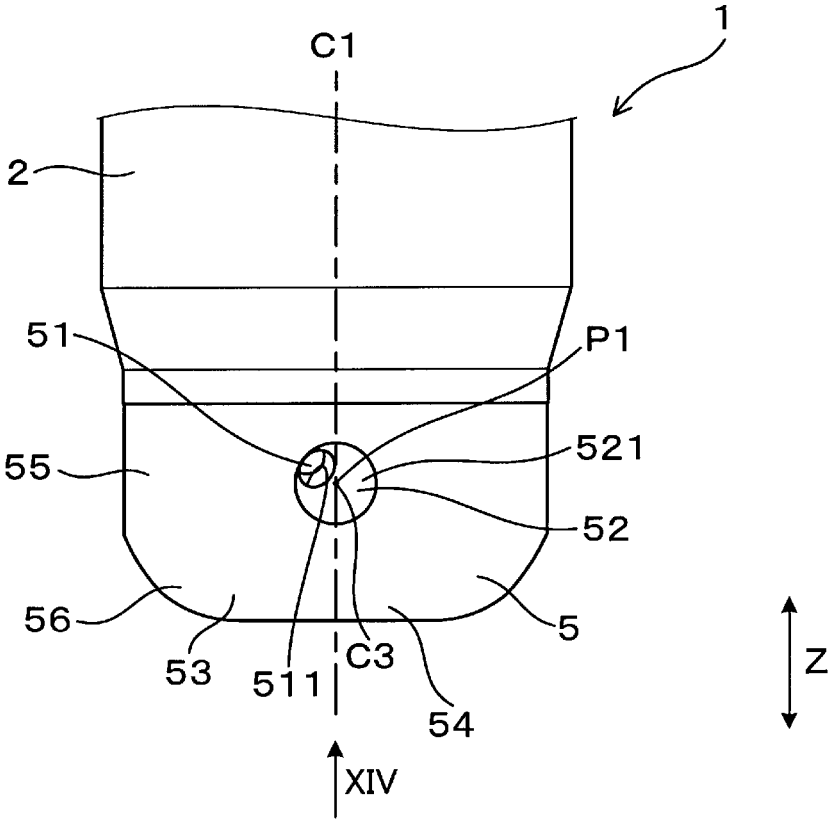
FIG. 13 is a plan view of the tip portion of the spark plug, according to a fourth embodiment.
Figure 14:
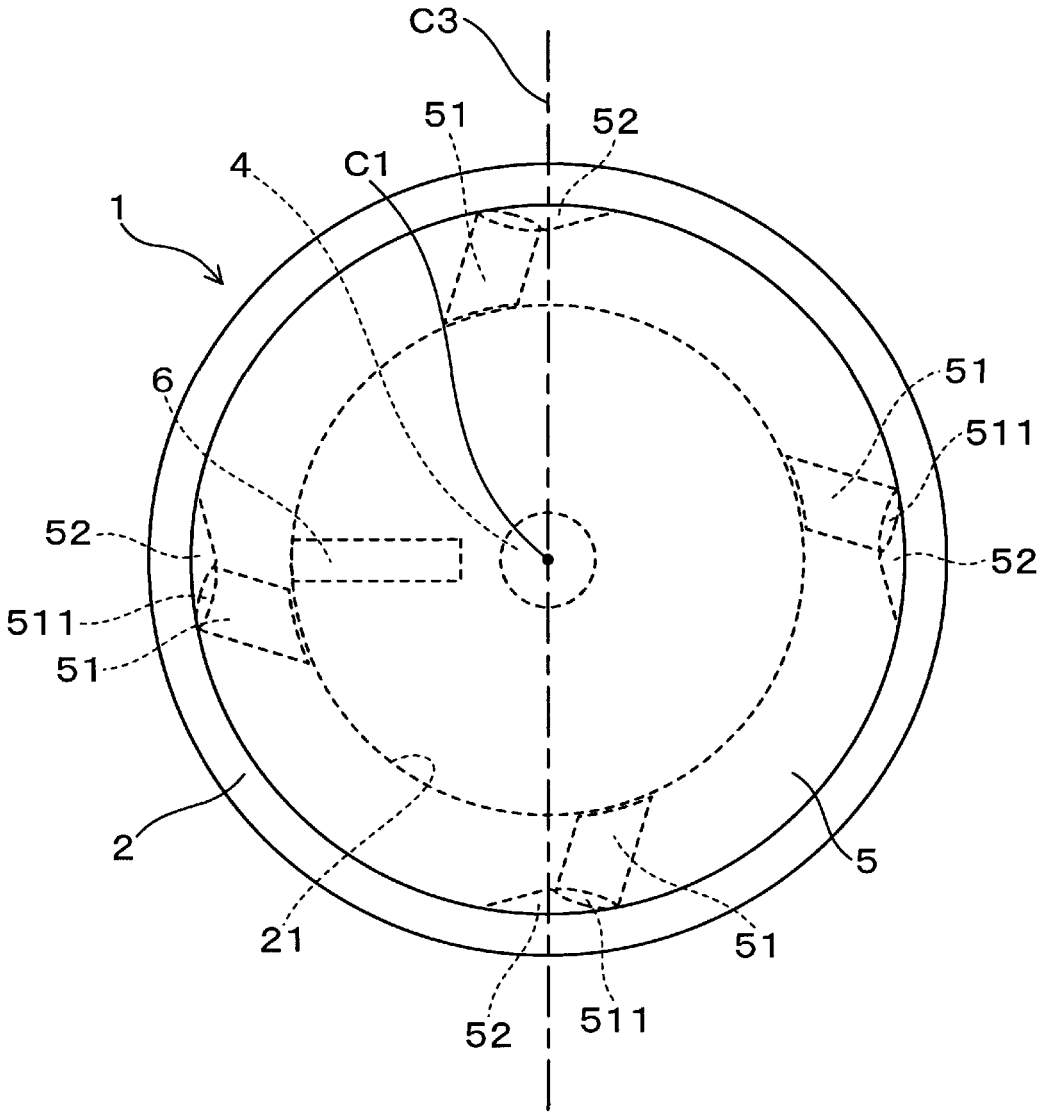
FIG. 14 is a plan view viewed in the direction of an arrow XIV of FIG. 13.

In the present embodiment, as illustrated in FIG. 13 and FIG. 14, the position at which the concave portion 52 of the plug cover 5 is formed in the first embodiment is modified.

In the present embodiment, as illustrated in FIG. 13, the concave portion 52 is formed in the peripheral wall portion 55 of the plug cover 5. As illustrated in FIG. 13 and FIG. 14, the concave portion 52 is formed so that the central axis C3 of the concave portion 52 is along the plug radial direction.

That is, the concave portion 52 is formed in the peripheral wall portion 55 of the plug cover 5 by performing cutting work in the plug radial direction with a drill. Then, after the concave portion 52 is formed, the nozzle hole 51 is produced in part of the concave portion forming face 521 along the normal direction of the part of the concave portion forming face 521.

The present embodiment provides other configurations and effects similar to those of the first embodiment.

The present disclosure is not limited to the above-described embodiments and can be applied to various embodiments within a scope not deviating from the gist of the present disclosure.

The present disclosure has so far been described based on some embodiments. However, the present disclosure should not be construed as being limited to these embodiments or the structures. The present disclosure encompasses various modifications, or modifications within the range of equivalence. In addition, various combinations and modes, as well as other combinations and modes, including those which include one or more additional elements, or those which include fewer elements should be construed as being within the scope and spirit of the present disclosure.

As an aspect of the present disclosure, a spark plug (1) for an internal combustion engine is provided. The spark plug includes: a cylindrical insulator (3); a center electrode (4) that is held on an inner periphery side of the insulator and projects from the insulator toward a tip side of the insulator; a cylindrical housing (2) that holds the insulator on an inner periphery of the housing; and a plug cover (5) that is provided to a tip portion of the housing. On the tip side of the insulator, an auxiliary combustion chamber (50) is formed which is surrounded by at least the plug cover, the plug cover is provided with nozzle holes (51) that communicate between the auxiliary combustion chamber and the outside of the auxiliary combustion chamber. A central axis (C2) of the nozzle hole is inclined with respect to a plug radial direction when viewed in a plug axial direction (Z). At least a part around an outer opening (511) of the nozzle hole is provided with a concave portion (52) that is adjacent to the outer opening, the concave portion being recessed from the outside to the inside of the plug cover.

As another aspect of the present disclosure, a method of manufacturing a spark plug for an internal combustion engine is provided. The spark plug has a cylindrical insulator (3), a center electrode (4) that is held on an inner periphery side of the insulator and projects from the insulator toward a tip side of the insulator, a cylindrical housing (2) that holds the insulator on an inner periphery of the housing, and a plug cover (5) that is provided to a tip portion of the housing. The method includes forming, on the tip side of the insulator, an auxiliary combustion chamber (50) that is surrounded by at least the plug cover, and forming, in the plug cover, nozzle holes (51) that communicate between the auxiliary combustion chamber and the outside of the auxiliary combustion chamber. A central axis (C2) of the nozzle hole is inclined with respect to a plug radial direction when viewed in a plug axial direction (Z). When the nozzle holes are formed in the plug cover, after a concave portion (52) that is recessed from the outside to the inside of the plug cover is formed in the plug cover, the nozzle hole is produced in at least a part of a concave portion forming face (521) on which the concave portion is formed.

In the spark plug for an internal combustion engine, the concave portion is formed in at least a part around the outer opening of the nozzle hole so as to be adjacent to the outer opening. Hence, when viewed in the plug axial direction, even if the central axis of the nozzle hole is inclined with respect to the plug radial direction, the plug cover can be processed easily. As a result, productivity in manufacturing the spark plug can be increased.

In the method of manufacturing the spark plug for an internal combustion engine, after the concave portion is formed in the plug cover, the nozzle hole is produced in at least a part of the concave portion forming face. Hence, when viewed in the plug axial direction, even if the central axis of the nozzle hole is inclined with respect to the plug radial direction, the plug cover can be processed easily. As a result, the spark plug can be manufactured effectively.

As described above, a spark plug and a method of manufacturing the same that can increase productivity can be provided.

What is claimed is:

1. A spark plug for an internal combustion engine, the spark plug comprising:

a cylindrical insulator;

a center electrode that is held on an inner periphery side of the insulator and projects from the insulator toward a tip side of the insulator;

a cylindrical housing that holds the insulator on an inner periphery of the housing; and a plug cover that is provided to a tip portion of the housing, wherein on the tip side of the insulator, an auxiliary combustion chamber is formed which is surrounded by at least the plug cover, the plug cover is provided with nozzle holes that communicate between the auxiliary combustion chamber and the outside of the auxiliary combustion chamber, a central axis of the nozzle hole is inclined with respect to a plug radial direction when viewed in a plug axial direction, and at least a part around an outer opening of the nozzle hole is provided with a concave portion that is adjacent to the outer opening, the concave portion being recessed from the outside to the inside of the plug cover.

2. The spark plug for an internal combustion engine according to claim 1, wherein the outer opening opens at a position deviated from a center of the concave portion in one of plug circumferential directions.

3. A method of manufacturing a spark plug for an internal combustion engine, the spark plug having a cylindrical insulator, a center electrode that is held on an inner periphery side of the insulator and projects from the insulator toward a tip side of the insulator, a cylindrical housing that holds the insulator on an inner periphery of the housing, and a plug cover that is provided to a tip portion of the housing, the method comprising:

forming, on the tip side of the insulator, an auxiliary combustion chamber that is surrounded by at least the plug cover, and forming, in the plug cover, nozzle holes that communicate between the auxiliary combustion chamber and the outside of the auxiliary combustion chamber, wherein a central axis of the nozzle hole is inclined with respect to a plug radial direction when viewed in a plug axial direction, and when the nozzle holes are formed in the plug cover, after a concave portion that is recessed from the outside to the inside of the plug cover is formed in the plug cover, the nozzle hole is produced in at least a part of a concave portion forming face on which the concave portion is formed.

* * * * *